US012035776B2

(12) United States Patent
Morello et al.

(10) Patent No.: US 12,035,776 B2
(45) Date of Patent: Jul. 16, 2024

(54) PROTECTIVE HELMET

(71) Applicant: LAZER SPORT NV, Mechelen (BE)

(72) Inventors: Angelo Fabrizio Morello, Losone (CH); Alfio Perregrini, Lugano (CH); Roberto Fortunato Tordi, Milan (IT)

(73) Assignee: LAZER SPORT NV, Mechelen (BE)

( * ) Notice: Subject to any disclaimer, the term of this patent is extended or adjusted under 35 U.S.C. 154(b) by 605 days.

(21) Appl. No.: 17/265,329

(22) PCT Filed: Aug. 14, 2019

(86) PCT No.: PCT/IB2019/056905
§ 371 (c)(1),
(2) Date: Feb. 2, 2021

(87) PCT Pub. No.: WO2020/035807
PCT Pub. Date: Feb. 20, 2020

(65) Prior Publication Data

US 2021/0315308 A1 Oct. 14, 2021

(30) Foreign Application Priority Data

Aug. 14, 2018 (CH) ..... 986/18
Aug. 14, 2018 (IT) ..... 102018000008089

(51) Int. Cl.
*A42B 3/06* (2006.01)

(52) U.S. Cl.
CPC ..... *A42B 3/068* (2013.01); *A42B 3/064* (2013.01)

(58) Field of Classification Search
CPC ..... A42B 3/06; A42B 3/061; A42B 3/063; A42B 3/064; A42B 3/068; A42B 3/10; A42B 3/125
See application file for complete search history.

(56) References Cited

U.S. PATENT DOCUMENTS 3,447,163 A 6/1969 Bothwell et al.
3,877,076 A 4/1975 Summers et al.
9,591,883 B2 * 3/2017 Kwan ..... A42B 3/125
(Continued)

FOREIGN PATENT DOCUMENTS

FR 2566632 A1 1/1986
FR 2786670 A1 6/2000

OTHER PUBLICATIONS

International Search Report and Written Opinion from PCT Application No. PCT/IB2019/056905, Dec. 6, 2019.
(Continued)

*Primary Examiner* — Sally Haden
(74) *Attorney, Agent, or Firm* — Workman Nydegger

(57) ABSTRACT

A protective helmet has an outer shell and one or more absorption elements of impact shock energy operatively coupled with the outer shell. The absorption elements include a working portion interposed between the end portions. The section of the working portion along a surface transverse to the development axis has an area smaller than the areas of the corresponding sections of the end portions. The absorption elements have a breaking load lower than the breaking load of the outer shell, so that in the event of an impact the working portion is subject to breaking before the outer shell and before the end portions to allow the absorption of the impact shock energy.

14 Claims, 8 Drawing Sheets

(56) References Cited

U.S. PATENT DOCUMENTS

| | | | | |
|---|---|---|---|---|
| 10,342,281 | B2 * | 7/2019 | Fischer | A42B 3/127 |
| 10,376,009 | B2 * | 8/2019 | Kennedy | F16F 1/54 |
| 10,660,389 | B2 * | 5/2020 | Brandt | B32B 27/18 |
| 10,939,719 | B2 * | 3/2021 | Brandt | B32B 27/065 |
| 10,966,479 | B2 * | 4/2021 | Browd | A42B 3/125 |
| 11,241,059 | B2 * | 2/2022 | Stone | A42B 3/065 |
| 2004/0168246 | A1 | 9/2004 | Phillips | |
| 2013/0305435 | A1 | 11/2013 | Surabhi | |
| 2015/0125663 | A1 * | 5/2015 | Faden | A41D 31/285 428/160 |
| 2016/0058092 | A1 | 3/2016 | Aldino et al. | |
| 2016/0242484 | A1 | 8/2016 | Morgan | |
| 2016/0316847 | A1 | 11/2016 | Weber et al. | |
| 2017/0303622 | A1 | 10/2017 | Stone et al. | |
| 2017/0303623 | A1 * | 10/2017 | Sicking | A42B 3/064 |
| 2018/0000186 | A1 | 1/2018 | Brown | |
| 2020/0163398 | A1 * | 5/2020 | Baker | A42B 3/069 |
| 2021/0323263 | A1 * | 10/2021 | Cagle | B32B 5/245 |

OTHER PUBLICATIONS

Search report from corresponding IT Application No. IT201800008089, Apr. 15, 2019.

* cited by examiner

PROTECTIVE HELMET

FIELD OF THE INVENTION

The present invention relates to a helmet, or hard hat, able to protect the head of a user against impacts. Particularly, the present invention relates to a protective helmet or hard hat made in such a way as to absorb, at least partially, the impacts suffered by the head of a user.

In the following description reference will be made, for the sake of brevity, to a motorcycle helmet, but what described can be applied to any type of helmet, or hard hat, used to protect the head of a user, for example helmets for motorbike sports competitions (cars, motorbikes, etc.), bike helmets, ski helmets or work hard hats (hard hats for excavator operators, hard hats for construction sites, etc.).

PRIOR ART

In the state of the art there are different types of helmets typically for sports use or for working use. Such helmets, or hard hats, are the most widely used and suitable instrument for protecting the user's head against impact injuries, therefore they are also referred to as protective helmets or hard hats. Particularly, the main purpose is to carry out a protective action against the possibility of possible skull fractures.

In this regard, the essential elements of any type of protective helmet consist of an outer shell, i.e. the portion of the protective helmet in contact with the external environment, and an inner lining, i.e. the portion of the protective helmet in contact with the user's head. The aforementioned essential elements cooperate to absorb the energy caused by a shock following an impact on the user's head.

The outer shell is typically made of a shock-resistant material and allows the distribution of impact force in an area wider than the shock one, reducing the concentration of tensions in a small area. The materials commonly used for making the outer shell are thermoplastic materials such as polycarbonate (PC) or acrylonitrile butadiene styrene (ABS), or composite materials (FRP) with epoxy resin glass or carbon fiber or exclusively carbon or Kevlar fibers.

The inner lining is typically made of a material able to absorb energy caused by a shock, e.g. expanded polystyrene (EPS), expanded polypropylene (EPP) or materials with similar mechanical behaviors. The inner lining is able to progressively collapse following the impact thus reducing the accelerations transmitted to the head.

The conformation of the outer shell and the inner lining is designed in such a way as to obtain a functional coupling of the two elements that allows mutual cooperation in order to contain or avoid impact trauma.

It is evident that the design parameters of both the outer shell and the inner lining are fundamental to obtain a protective helmet able to obtain a gradual and controlled deceleration of the head in the event of impact, while defining a functional structure for daily use. Particularly, the main elements of the design are the thickness and the impact resistance of the outer shell, as well as the thickness and density of the inner lining.

Although the design of the protective helmets has evolved very quickly over time, today one of the main problems concerns the absorption of energy related to the initial impact force. During an impact when the inner lining collapses completely, the part of unabsorbed energy is transferred to the head often causing serious injuries, particularly injuries that do not appears with a cranial fracture or, at least to a first investigation, with a visible injury of the soft tissue. Only a residual amount of unabsorbed energy is reduced by the outer shell in an estimated quantity not exceeding 30%.

To improve the absorption capacity of the impact shock energy, helmets have been developed with an inner lining consisting of deformable ABS cones. Such solution allows the absorption of the energy through the bending and/or collapse of the cones obtaining a better mode of absorption of impacts compared to traditional protective helmets.

A further innovation consists in providing the protective helmet with an inner lining made by two layers with different densities, i.e. an outermost layer, at the outer shell, with greater density and an innermost layer, at the user's head, with lower density. Such solution allows, in the event of impact, to compress the inner layer with lower density obtaining a gradual deceleration of the head and the possibility of distributing the impact energy on a wider surface inside the inner lining.

Further known solutions provide for the use of additional energy absorption elements, interposed between the outer shell and the inner lining. Such solution is, e.g., described in US2016/0058092 wherein a plurality of frusto-conical elements in rigid expanded solid material with open cells allow, in the event of impact, to obtain compression crushing with irreversible deformation, i.e. of plastic type, which is able to absorb the impact energy.

A problem relating to the aforementioned solutions consists in that the attenuation of the impact energy and, consequently, the protection of the user's head is entrusted to the inner lining, since the outermost covering allows only the mechanical protection from the impact and not its absorption.

Furthermore, the impact energy is redistributed rather than dissipated, thus maintaining a high risk of causing damage to the soft tissue even in the absence of obvious fractures of the cranial theca, particularly during crawling impacts.

It would therefore be desirable to have a protective helmet able to minimize the disadvantages described above. Particularly, it would be desirable to have a protective helmet able to guarantee a better dissipation of the impact energy, preserving the user's head in any type of impact. Furthermore, it would be desirable to have a protective helmet able of guaranteeing better protection also in case of angular and rotational impacts.

SUMMARY OF THE INVENTION

The object of the present invention is to provide a protective helmet, or hard hat, able to minimize the aforementioned drawbacks.

Particularly, the object of the present invention is to provide a protective helmet, or hard hat, able to considerably reduce the traumatic injuries of the cranial theca and, particularly, of the parietal, temporal, frontal and occipital bones, but also of the soft tissues which are crucial for the individual.

Another object of the present invention is to provide a protective helmet or hard hat able to considerably reduce injuries of any kind in case of angular and rotational impacts.

Finally, an object of the present invention is to provide a protective helmet or hard hat able to improve the acoustic and thermal insulation with respect to the surrounding environment.

The aforementioned objects are achieved by a protective helmet according to the attached claims.

The protective helmet comprises:

an outer shell;

one or more absorption elements of impact shock energy operatively coupled with the outer shell, wherein the absorption elements are shaped with a geometric configuration which extends along a development axis such as to define a pair of end portions opposite to each other;

the protective helmet is characterized in that the absorption elements comprise a working portion interposed between the end portions, wherein the section of the working portion along a surface transverse to the development axis has an area smaller than the areas of the corresponding sections of the end portions, and wherein the absorption elements have a breaking load lower than the breaking load of the outer shell, so that in the event of an impact the working portion is subject to breaking before the outer shell and before the end portions to allow the absorption of the impact shock energy.

In such way, in the event of impact, the absorption elements considerably reduce the traumatic injuries of the cranial theca and, particularly, of the parietal, temporal, frontal and occipital bones, but also of the soft tissues that are crucial for the individual, also in case of angular and rotational impacts.

Preferably, the sections of the end portions have a different area and/or conformation. Even more preferably, the working portion is brought closer to one of the end portions. Even more preferably, the absorption elements have an asymmetrical configuration with respect to the development axis.

Preferably, the absorption elements are coupled with a support element at one of the end portions so as to define a single absorption element.

In such way, it is possible to produce the absorption elements at a reduced cost, maintaining the breaking capacity unchanged.

Even more preferably, the support element is coupled with the outer shell by means of a surface provided with the same curvature as the outer shell.

In such way, it is possible to define the assembly of the absorption elements with the protective helmet with a reduced use of time and resources.

Preferably, the absorption elements are hourglass-shaped.

The hourglass conformation offers a wide support base with a central breaking point that allows the management of both direct and crawling traumas.

Alternatively, the absorption elements have a cylindrical conformation provided with one or more holes at the working portion, wherein the holes are transverse and/or axial to the development axis.

Preferably, the protective helmet comprises an inner lining, wherein the absorption elements are interposed between the outer shell and the inner lining. Alternatively, the protective helmet comprises an inner lining coupled with the outer shell, wherein the absorption elements are coupled with the inner lining, so that the inner lining is interposed between the outer shell and the absorption elements.

In such way, it is possible to integrate the absorption elements to the helmets with a structure of the known type.

Preferably, the protective helmet comprises a coating shell, wherein the coating shell is superimposed on the outer shell. Alternatively, the protective helmet comprises a coating shell, wherein the absorption elements are interposed between the outer shell and the coating shell.

Even more preferably, the coating shell is provided with one or more notches, preferably defined along the inner surface of the coating shell at the outer shell able to define a predefined breaking scheme in the event of an impact.

This allows to obtain a more accurate control during collapse of the coating shell, thus considerably reducing the traumatic injuries of the cranial theca and, particularly, of the parietal, temporal, frontal and occipital bones, but also of the soft tissues which are crucial for the individual.

The realization of suitable impact portions, particularly of identical impact portions preferably with a hexagonal geometrical shape, allows to obtain breaks which can adapt to a plurality of cranial thecae, without the need to define a customized protective helmet. Furthermore, the size of the aforementioned impact portions influences the ability to absorb the shock energy.

Preferably, the coating shell has a breaking load lower than the outer shell, and wherein the absorption elements have a breaking load lower than or equal to the breaking load of the coating shell, so that in the event of an impact the working portion is subject to breaking before the coating shell or together with the breaking of at least a portion of the coating shell for the collapse of the coating shell towards the outer shell.

In such way, it is possible to obtain a better energy dissipation in the event of an impact, without affecting the outer shell.

Preferably, the coating shell is coupled with the outer shell or to the absorption elements in a removable manner.

This allows the coating shell to be replaced in the event of breaking or wear.

DETAILED DESCRIPTION OF THE INVENTION

With reference to FIGS. 1, 2A, 3, 4, 5 and 6 respectively a first, a second, a third, a fourth, a fifth and a sixth embodiment of a protective helmet are illustrated, according to the present invention. In particular, the same numerals will be maintained in the following for the same elements but relating to different embodiments.

In the following description reference will be made, for the sake of brevity, to a motorcycle helmet, but what described can be applied to any type of helmet, or hard hat, used to protect the head of a user, for example helmets for motorbike sports competitions (cars, motorbikes, etc.), bike helmets, ski helmets or work hard hats (hard hats for excavator operators, hard hats for construction sites, etc.).

Figure 1:
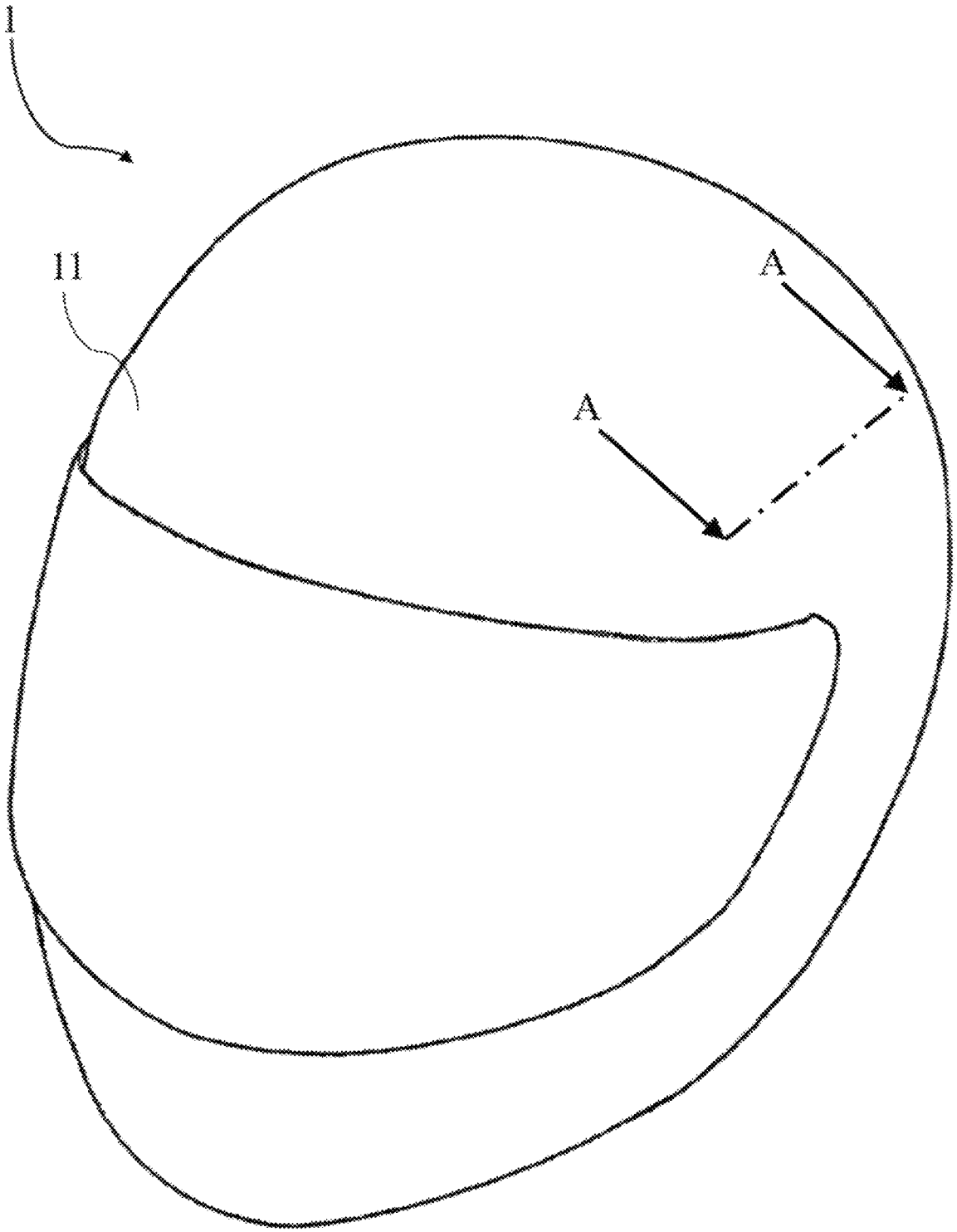
FIG. 1 illustrates an exemplary embodiment of a protective helmet.

FIG. 1 illustrates by way of example the protective helmet 1 according to a first embodiment and of the integral type, but what has been described can also be applied to helmets of the modular type or devoid of a chin-rest. The protective helmets, of any type, can be provided with a plurality of components, comprising the comfort padding, the closure strap, the visor and the aeration system which will not be described in detail below as they are not essential for obtaining the purpose of the invention.

Figure 1A:
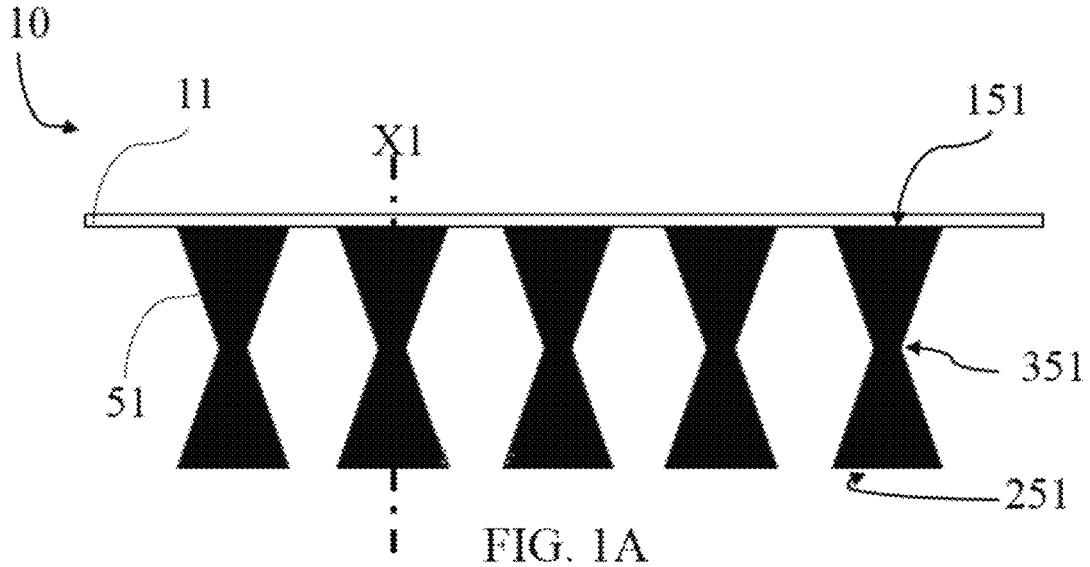
FIGS. 1A-1C illustrate sectional configurations of absorption elements of the protective helmet of FIG. 1.
Figure 1B:
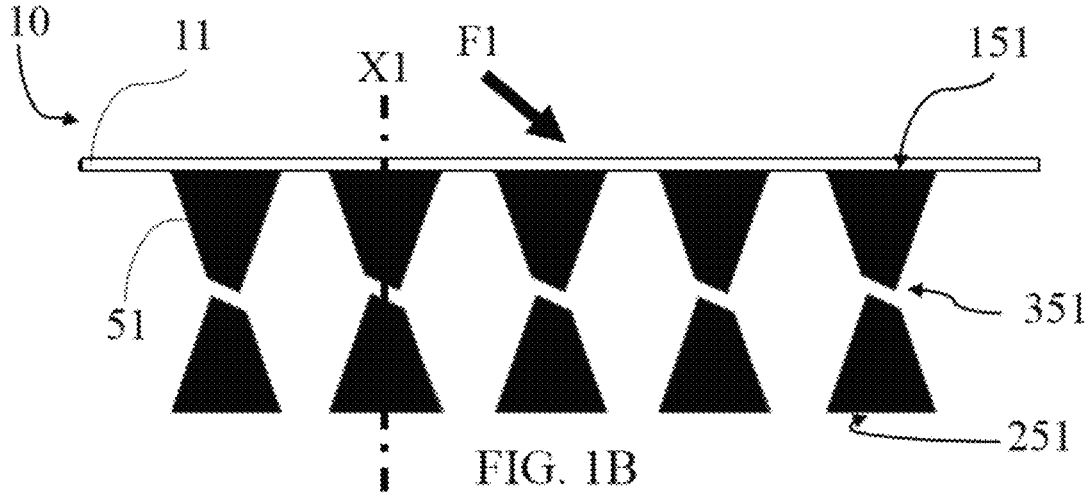
Figure 1C:
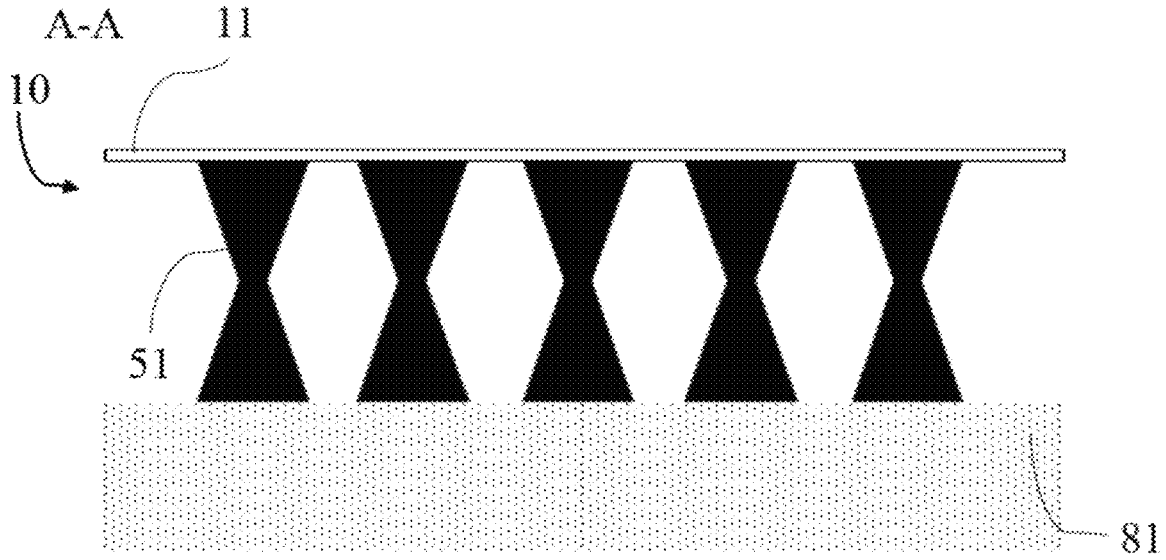

In the embodiment illustrated in FIG. 1, the protective helmet 1 comprises a plurality of layers more detailed in FIG. 1C. Particularly, the protective helmet 1 comprises from the outside towards the inside an outer shell 11, a plurality of absorption elements 51 of the impact shock energy operatively coupled with the outer shell 11 and a comfort padding layer 81. This last layer is not essential for obtaining the invention but it is present in most of protective helmets of the known type.

The coupling of the layers is made in a way suitable to absorb the impact shock energy, i.e. to allow the absorption of the energy accumulated during the impact of a portion of the protective helmet 1 with a fixed or mobile obstacle.

Thus, the aforementioned sequence of layers corresponds to the same coupling sequence between them. Particularly, the comfort padding 81 is coupled with the absorption elements 51, preferably by means of a coupling of the removable type which can allow maintenance of the padding 81 itself. At the same time, the absorption elements 51 are integrally coupled with the outer shell 11, by means of a coupling which can be either of the removable type or of the non-removable type, e.g. fixed by mechanical coupling or gluing. Particularly, the coupling of the removable type of the absorption elements 51 allows their possible verification and/or replacement, e.g. in case of accidental impacts such as the fall of the protective helmet 1 when non-operational.

The outer shell 11 is preferably made of a shock-resistant material and allows the distribution of the energy generated by the impact force in an area wider than the shock one, reducing the concentration of tensions in a small area. Preferably, the materials commonly used for making the outer shell 11 are thermoplastic materials such as polycarbonate (PC) or acrylonitrile butadiene styrene (ABS), or composite materials (FRP) with epoxy resin glass or carbon fiber or exclusively carbon or Kevlar fibers. The thickness of the outer shell 11 can be sized according to the technical and strength requirements, without affecting the technical characteristics of the invention.

The comfort padding 81, which represents the interface between the entire structure of the protective helmet 1 and the user's head, is preferably made by a combination of sponges coated with fabric, or other suitable material, which allow to increase comfort during the use of the protective helmet 1 but which affect in any way the ability of the protective helmet 1 to absorb the stresses to which it may be subjected.

The absorption elements 51 are shaped with a geometric configuration which extends along a development axis X1 such as to define a pair of end portions 151, 251 opposite to each other and a working portion 351 interposed between the end portions 151, 251. The section of the working portion 351 along a surface (not shown) transverse to the development axis X1 has an area smaller than the areas of the corresponding sections of the end portions 151, 251. Particularly, the transverse surface is preferably defined perpendicularly to the development axis X1 but could also have different inclinations. The section to which reference is made could relate to all the sections of the infinite planes which constitute the respective reference portion. Moreover, the absorption elements 51 have a breaking load lower than the breaking load of the outer shell 11, so that in the event of an impact the working portion is subject to breaking before the outer shell 11 and before the end portions to allow the absorption of the impact shock energy.

The absorption elements 51 according to the present invention can be made, e.g., of polymeric material such as solid foams with open cells or solid cells with closed cells, but further materials fall however within the inventive concept of the present invention. Moreover, the aforementioned absorption elements 51 can be made by machining by chip removal, for example hot-wire cutting, but further types of production fall however within the inventive concept of the present invention, such as molding, sintering, laser cutting, thermoforming, etc.

The term "breaking load" means, in the present invention, the limit, in terms of applied outer force or stress, beyond which the product, or the material composing it, is irreparably damaged from the point of view of mechanical strength. By way of example, the breaking load may relate to one or more of the following types: tensile breaking load, compressive breaking load, right bending breaking load, torsional breaking load and shear stress breaking load.

In the first embodiment detailed therein, the absorption elements 51 have a symmetrical configuration with respect to the development axis X1, wherein the sections of the end portions 151, 251 have the same area and conformation, where the working portion 351 is equidistant from the aforementioned end portions 151, 251. Particularly, the conformation of the absorption elements 51 is of the hourglass type, i.e. with two areas having a larger surface, at the respective end portions 151, 251, connected by a section with a smaller surface area, at the working portion 351. In the first embodiment illustrated therein, the aforementioned larger surface areas are respectively coupled with the outer shell 11 and with the comfort padding 81, thus arranging the section with smaller surface area between them. The central breaking of the absorption elements 51 allows to optimize the management of the shock energy absorption both in direct and in crawling traumas.

According to further embodiments, not shown, the sections of the end portions may have a different area and/or conformation. Moreover, the working portion can be brought closer to one of the end portions. Finally, the absorption elements have an asymmetrical configuration with respect to the development axis. However, different conformations of the absorption elements are still possible. For example, the absorption elements could have a cylindrical conformation and could be provided with one or more holes at the working portion, particularly with holes transversely and/or axially made with respect to the development axis. This would however allow to obtain a section of the working portion provided with a lower area with respect to the sections of the end portions, e.g. of the respective end surfaces, while maintaining an outer conformation without geometric discontinuities.

FIGS. 1A-1C illustrate, by way of example, a number equal to five absorption elements 51, but the number thereof can vary according to the area of the outer shell 11 to be coupled, the technical absorption characteristics to be obtained, as well as the technical characteristics concerning the breaking load of the absorption elements 51 themselves. The coupling between the outer shell 11 and the absorption elements 51 defines an absorption portion 10, which is able to significantly improve the absorption capacity of the impact energy by the protective helmet 1.

In fact, the absorption elements 51 have a breaking load lower than the breaking load of the aforementioned outer shell 11. The difference in the breaking load is such that, in the event of an impact, the absorption elements 51 are subject to breaking before the outer shell 11.

Regardless of the conformation of the absorption elements, these are shaped in such a way as to obtain a predefined breaking at the working portion, in the form shown therein arranged between the outer shell 11 and the comfort padding 81. In the hourglass conformation illustrated in FIGS. 1, 1A-1C of the first embodiment, the working portion 351 is obtainable at the central area with a smaller area that joins the two portions provided with the respective surfaces to a larger area but, as described, such portion could be closer to one of the two end portions.

The functionality of the protective helmet 1 is described below, assuming an impact of the oblique type, e.g. angular and rotational impacts, often able to cause an injury widespread among motorcycle accidents, i.e. a trauma of the "closed head injury" type. Such trauma consists in the movement of the soft tissue inside the cranial theca following the accelerations and decelerations transmitted to the head during an impact.

In the case of an oblique impact, known helmets generally fail to absorb the impact energy in such a way as to reduce the angular acceleration of the user's head within safety threshold values. This is because the known helmets are designed to redistribute the energy over an area greater than the impact one and to resist the impact itself, particularly in the presence of blunt instruments.

The protective helmet 1, according to the present invention, instead allows to significantly reduce the energy transmitted to the user's head, dissipating much of the same impact energy in the absorption portion 10, i.e. by means of the portion of the protective helmet 1 consisting of the outer shell 11 and the respective absorption elements 51. Particularly, in the event of impact, the absorption elements 51 dissipate the energy by means of the controlled breaking of the same at the working portion.

FIGS. 1A and 1B respectively show the sectional configuration of a portion of the protective helmet 1 before the impact and the same configuration following the impact with a localized force F1 obliquely applied with respect to the surface of the outer shell 11, to generate an oblique impact. It is evident that the limit of the breaking load of the absorption elements 51, lower than that of the outer shell 11, allows the impact energy to be dissipated due to the controlled breaking of the same, by transmitting a limited amount of residual energy to the user. Moreover, the hourglass conformation of the absorption elements 51 offers a wide support base with a central working portion that allows the management of both direct and crawling traumas.

Figure 2A:
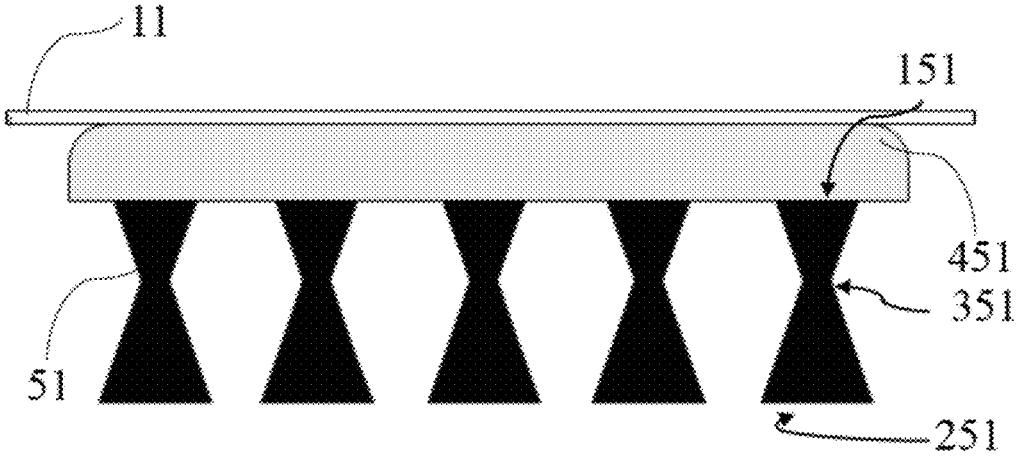
FIGS. 2A-2C illustrate another embodiment of sectional configurations of absorption elements in which the absorption elements are coupled with a support element.
Figure 2B:
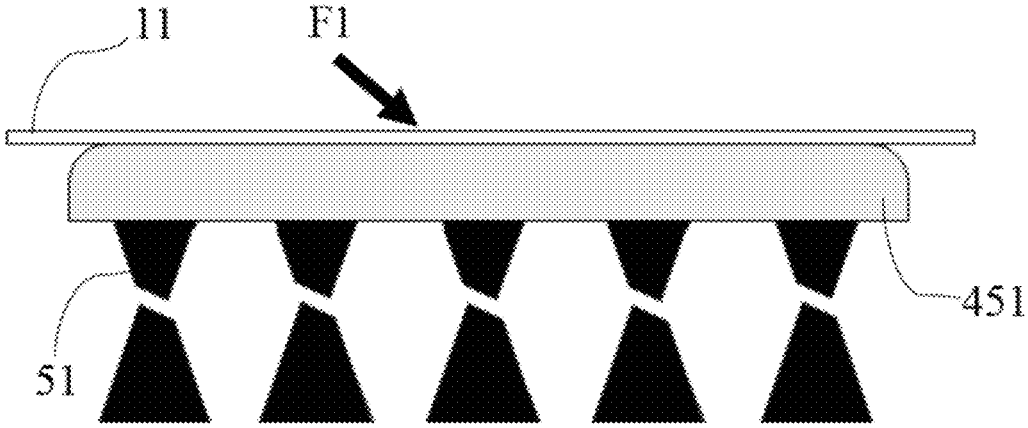
Figure 2C:
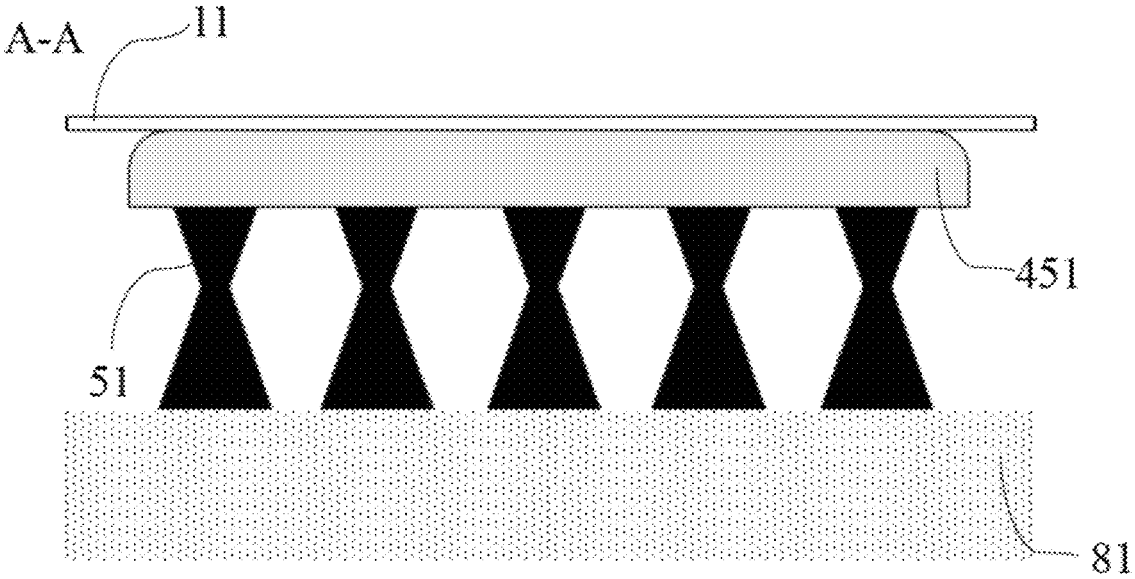

FIGS. 2A-2C illustrate a second embodiment wherein the protective helmet has absorption elements 51 coupled with a support element 451 at one of the end portions 151 so as to define a single absorption element. Particularly, in the second embodiment illustrated therein, the absorption elements 51 correspond to the same absorption elements 51 of the first embodiment, where the support element 451 couples the end portions 151 at the outer shell 11.

Such support element 451 allows to define a single structure provided with a plurality of absorption elements 51, wherein the support element 451 can be made of the same material of the absorption elements 51 or of a different material, e.g. with a different density.

In FIGS. 2A-2C the support element 451 is schematically illustrated flat at the outer shell 11 but, according to further embodiments not shown, the support element can be coupled with the outer shell by means of a surface provided with the same curvature of the outer shell.

The above description for the first embodiment, including any modifications not illustrated, materials and production methods, can be applied, mutatis mutandis, to the second embodiment.

The functionality of the protective helmet provided by the absorption elements 51 according to the second embodiment will not be described in detail below as it corresponds to what described previously for the protective helmet 1 of the first embodiment and which is therefore incorporated for reference.

Figure 3:
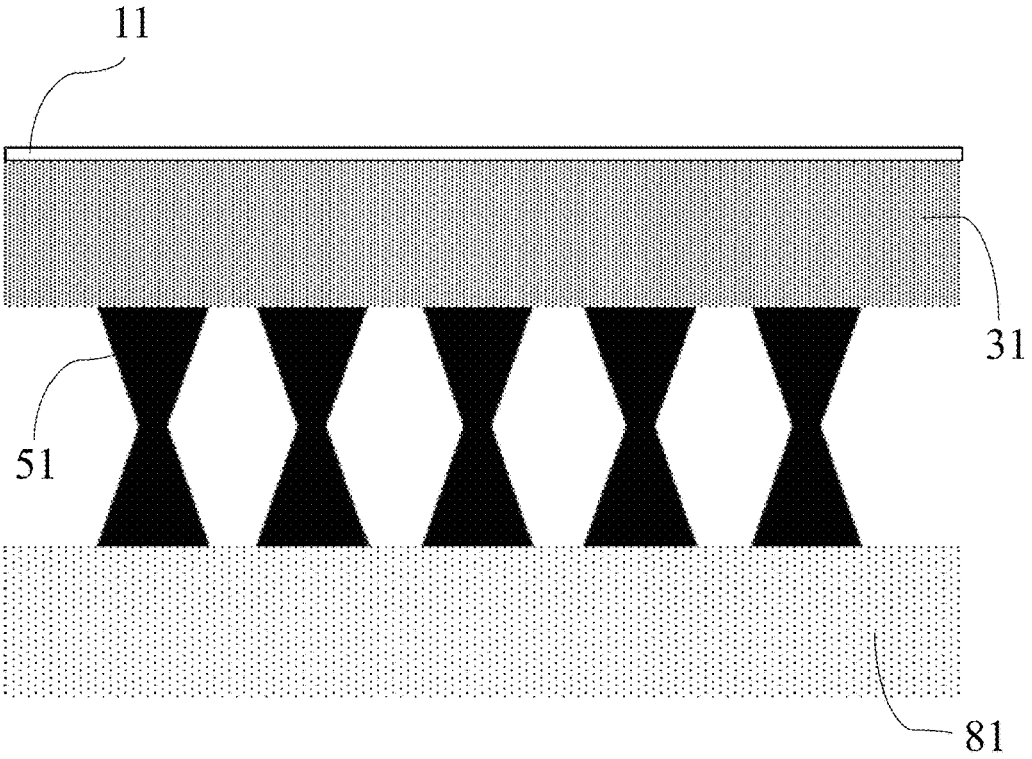
FIG. 3 illustrate another embodiment of section configurations of absorption elements interposed between the an outer shell and an inner lining of a protective helmet.
Figure 4:
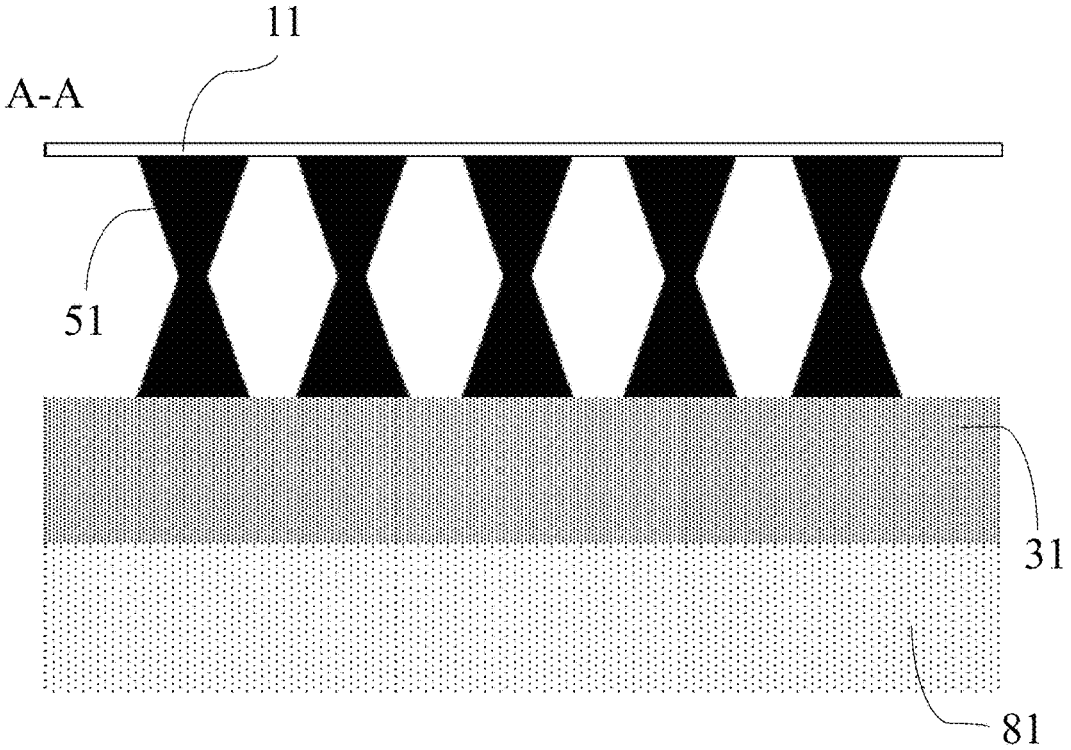
FIG. 4 illustrate another embodiment of section configurations of absorption elements coupled with the outer shell and/or the absorption element.

The protective helmet according to the present invention could further comprise an inner lining 31, as shown in the related FIGS. 3 and 4 respectively to a third and fourth embodiment of the invention.

The inner lining 31 is preferably made of a material able to absorb energy caused by a shock, e.g. expanded polystyrene (EPS), expanded polypropylene (EPP) or materials with similar mechanical behaviors. The inner lining 31 illustrated in FIGS. 3 and 4 is made as a single density monobloc able to progressively collapse following the impact thus reducing the accelerations transmitted to the head. Also, in this case, the type of structure and the thickness of the inner lining 31 can be made and sized according to the technical and strength requirements, without affecting the technical characteristics of the invention.

Particularly, in FIG. 3 the absorption elements 51 are interposed between the said outer shell 11 and the inner lining 31.

Conversely, in FIG. 4 the inner lining 31 is coupled with the outer shell 11, while the absorption elements 51 are coupled with the inner lining 31, so that the inner lining 31 is interposed between the outer shell 11 and the absorption elements 51.

However, the inner lining 31, is integrally coupled with the outer shell 11 and/or the absorption element 51, respectively, by means of a coupling which can be either of the removable type or of the non-removable type, e.g. by mechanical coupling or gluing. Particularly, the coupling of the removable type with the absorption elements 51 allows their possible verification and/or replacement, e.g. in case of accidental impacts such as the fall of the protective helmet 1 when non-operational.

Furthermore, it is possible that the inner lining is arranged around the absorption elements (not shown), i.e. in contact with the outer shell in the portions thereof which are not coupled with corresponding absorption elements.

The above description for the first and the second embodiment, including any modifications not illustrated, materials and production methods, can be applied, mutatis mutandis, to the third and fourth embodiments.

Moreover, the functionality of the aforementioned third and fourth embodiments will not be described in detail below as it corresponds to what described previously for the protective helmet 1 of the first embodiment and which is therefore incorporated for reference.

Figure 5:
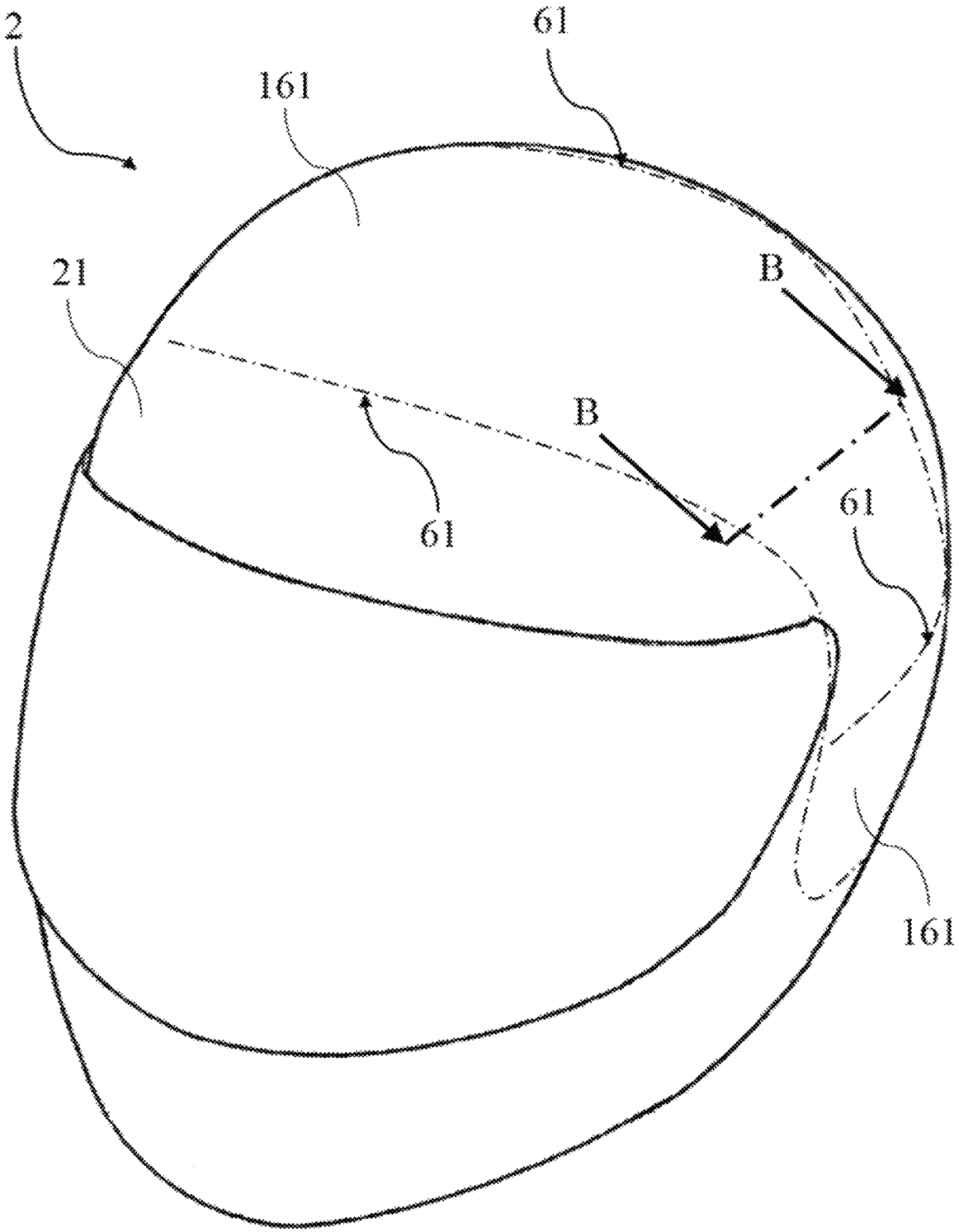
FIG. 5 illustrates another exemplary embodiment of a protective helmet.

In the fifth embodiment shown in FIG. 5, the protective helmet 2 comprises a plurality of layers and, particularly, from the outside towards the inside of a coating shell 21, a plurality of absorption elements 51, an outer shell 11, an inner lining 31 and a comfort padding 81.

According to the present invention, the coating shell 21 is provided with one or more notches 61 able to define a predefined breaking scheme of the outer shell 11 in case of impact. Preferably, as shown in FIG. 5 and in the further FIGS. 5A-5C according to the fifth embodiment, the notches 61 are defined along the inner surface 111 of the coating shell 21 at the outer shell 11, thus being not visible from the outer surface of the protective helmet 2. In such way, the aesthetics of the protective helmet 2 is preserved by maintaining the required functions in absorbing the impact forces and allowing to verify the functionality of the protective helmet 2 even after accidental falls. According to further embodiments (not shown), the aforementioned notches may not be realized.

As shown in FIG. 5, the coating shell 21 according to the fifth embodiment is characterized by a particular definition of the notches 61 which define a plurality of impact portions 161 at least partly side by side. Particularly, the notches 61 and the related impact portions 161 are preferably defined in such a way as to delineate a structure similar to the sutures of the skull and to the related bones that they define. Thus, the impact portions 161 allow to identify, by way of example, controlled breakings wherein the surfaces of the impact portions 161 are preferably able to cover macro areas of the cranial theca, preferably at least related to the parietal, temporal, frontal and occipital bones.

The thickness of the coating shell 21 can be sized according to the technical and strength requirements, without affecting the technical characteristics of the invention. Similarly, the depth of the notches can be sized according to the technical and strength requirements, without affecting the technical characteristics of the invention.

The coupling of the layers is made in a way suitable to absorb the impact shock, i.e. to allow the absorption of the energy accumulated during the impact of a portion of the protective helmet 2 with a fixed or mobile obstacle.

Thus, the aforementioned sequence of layers corresponds to the same coupling sequence between them. Particularly, the comfort padding 81 is coupled with the inner lining 31, preferably by means of a coupling of the removable type which can allow maintenance of the padding 81 itself. At the same time, the inner lining 31 is integrally coupled with the outer shell 11, by means of a coupling of the non-removable type, e.g. fixed by gluing.

The latter is therefore operatively coupled both with the inner lining 31 and the coating shell 21, the outer shell 11 being disposed between the coating shell 21 and the inner lining 31.

The coupling between the outer shell 11 and the coating shell 21 is made by means of a plurality of absorption elements 51 having a size such as to realize an interspace 41 between the aforementioned shells 11, 21. Particularly, the absorption elements 51 are interposed between the outer shell 11 and the coating shell 21.

The coupling between the coating shell 21, the outer shell 11 and the absorption elements 51 defines an absorption portion 10, which is able to significantly improve the absorption capacity of the impact energy by the protective helmet 2.

The absorption elements 51 have a breaking load lower than the breaking loads of the aforementioned outer shell 11 as well the aforementioned coating shell 21. The difference in the breaking load is such that, in the event of an impact, the absorption elements 51 are subject to breaking before the outer shell 11 and the coating shell 21. The aforementioned sizing of the breaking loads allows to obtain the collapse of the coating shell 21 in the interspace 41 towards the outer shell 11.

It is further possible to size the absorption elements 51 in such a way that the breaking load is such that, in the event of an impact, these are subject to breaking simultaneously with the breaking of at least a portion of the coating shell 21, preferably along one or more of the notches with which it is provided according to what described above.

Regardless of the conformation of the absorption elements 51, these are shaped in such a way as to obtain a predefined breaking in a breaking portion (not shown) arranged between the coating shell 21 and the outer shell 81. In the hourglass conformation illustrated in Figures of the first embodiment, the breaking portion is obtainable at the area with a smaller area that joins the two portions provided with the respective surfaces to a larger area.

To optimize the absorption capacity of the shock energy of the protective helmet 2, the coating shell 21 is further sized so as to have a breaking load lower than that of the outer shell 11. In such way, it is possible to obtain a better energy dissipation in the event of an impact, without affecting the outer shell 11.

In a further embodiment, not illustrated, the coating shell is coupled, and superimposed on the outer shell and/or on the absorption elements in a removable manner. Particularly, the coating shell can be further provided with a plurality of housings for coupling with the absorption elements.

This allows the coating shell to be replaced in relation to the related wear.

The functionality of the protective helmet 2 is described below, assuming an impact of the oblique type, as described above.

Figure 5A:
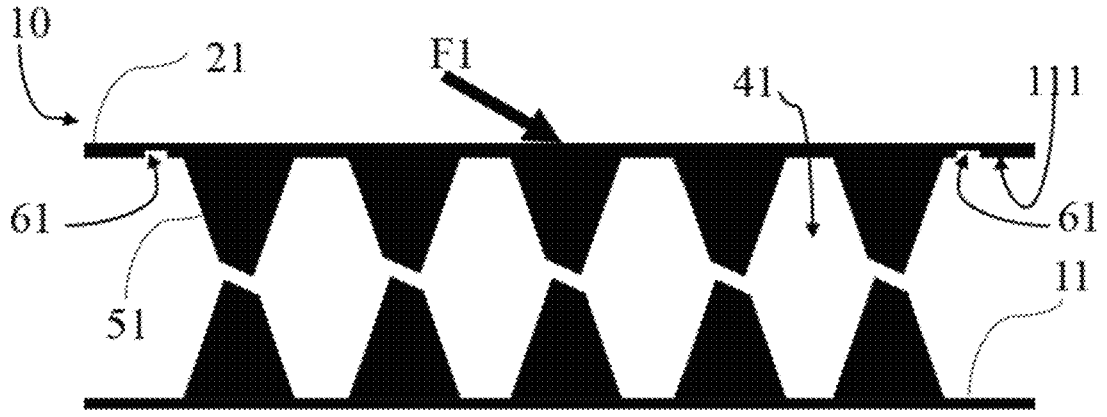
FIGS. 5A-5C illustrate sectional configurations of absorption elements of the protective helmet of FIG. 5.

FIG. 5A illustrates the sectional configuration of a portion of the protective helmet 2 following the impact with a localized force F1 obliquely applied with respect to the surface of the coating shell 21, to generate an oblique impact. It is evident that the limit of the breaking load of the absorption elements 51, lower than that of the coating shell 21 and the outer shell 11, allows the impact energy to be dissipated due to the controlled breaking of the same, by transmitting a limited amount of residual energy to the outer shell 11 and, consequently, to the inner lining 31.

Figure 5B:
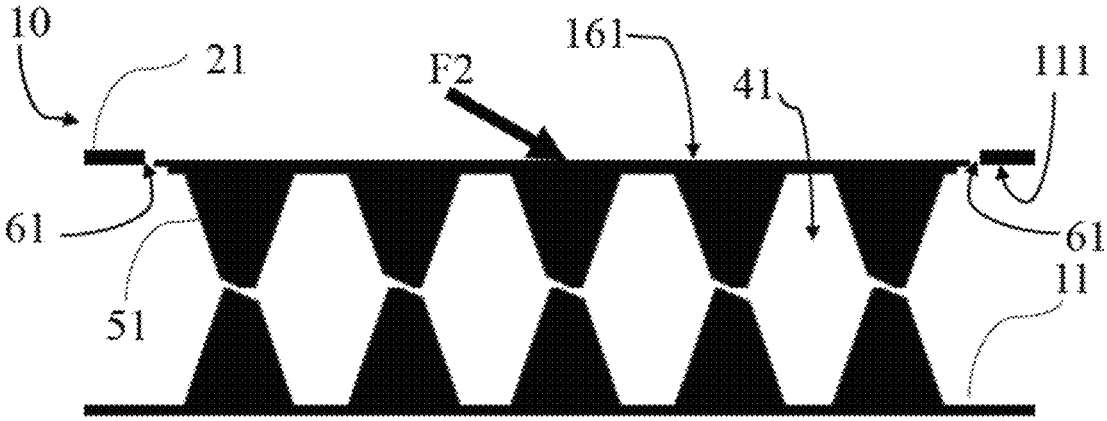
Figure 5C:
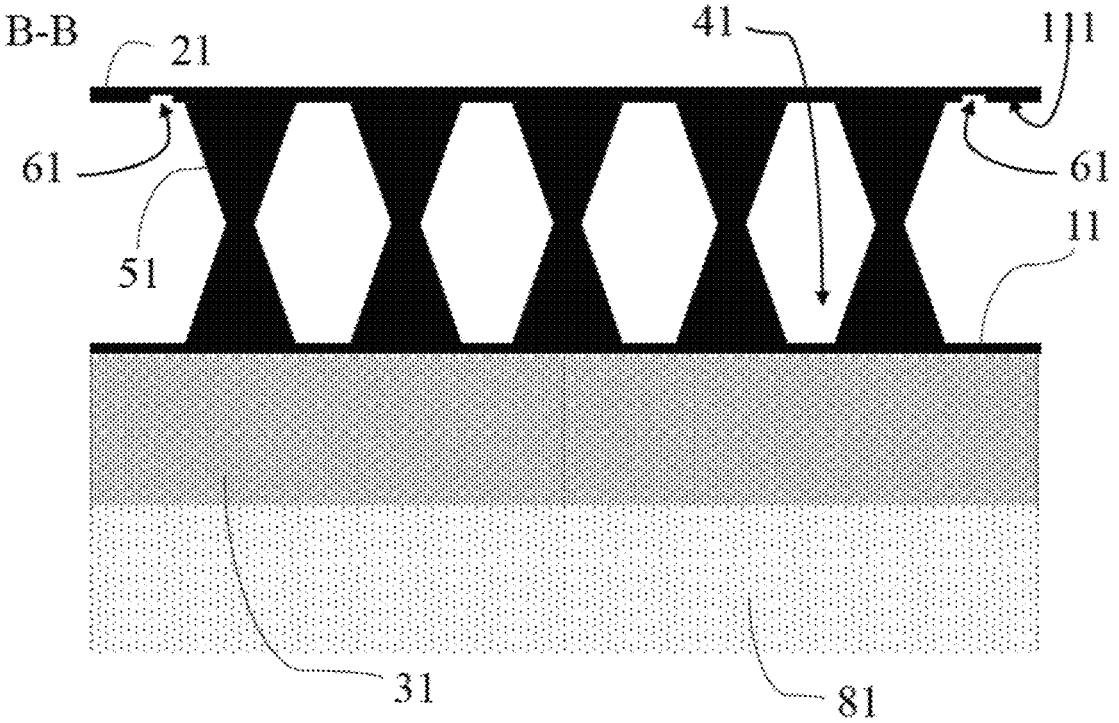

FIG. 5B illustrates a further ability to dissipate impact energy, when a localized force F2, greater than the localized force F1, also applied obliquely with respect to the surface of the coating shell 21, generates an oblique impact. In such case, the protective helmet 2 is able to dissipate the impact energy also by breaking, i.e. separating the coating shell 21 from the outer shell 11, allowing the coating shell 21 to collapse within the interspace 41 for the absorption of the impact force. As shown in FIG. 5B, the breaking of the coating shell 21 is preferably carried out at the notches 61 (where envisaged), separating the entire impact portion 161. This allows to obtain a more accurate control during collapse of the coating shell 21, thus considerably reducing the traumatic injuries of the cranial theca and, particularly, of the parietal, temporal, frontal and occipital bones, but also of the soft tissues which are crucial for the individual.

The same behavior illustrated in FIG. 5B is also obtained when the breaking load of the absorption elements 51 and of the coating shell 21 is such as to allow the breaking of the aforementioned absorption elements 51 simultaneously with the breaking of at least a portion of the outer shell 21.

The above description for the previous embodiments, including any modifications not illustrated, materials and production methods, can be applied, mutatis mutandis, to the fifth embodiment.

Figure 6:
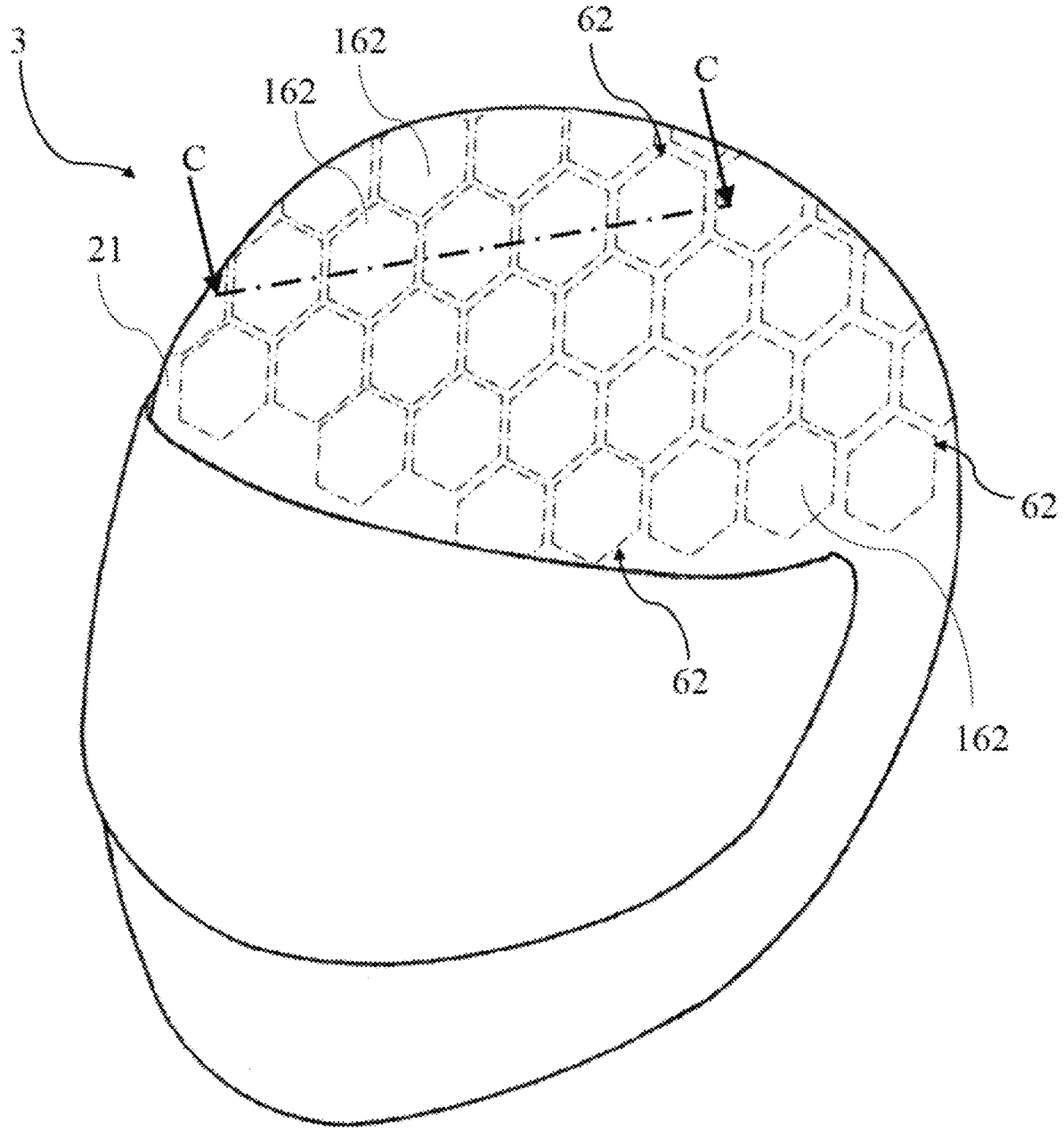
FIG. 6 illustrates yet another exemplary embodiment of a protective helmet.
Figure 6A:
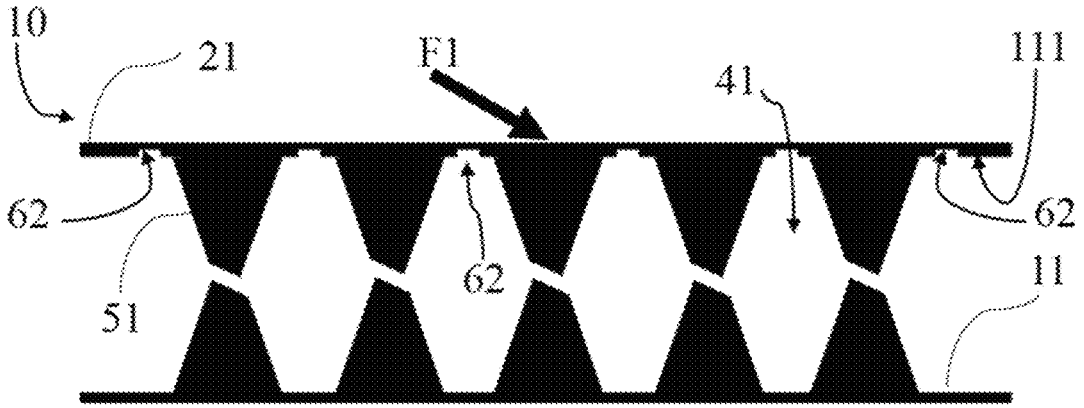
FIGS. 6A-6C illustrate sectional configurations of absorption elements of the protective helmet of FIG. 6.
Figure 6B:
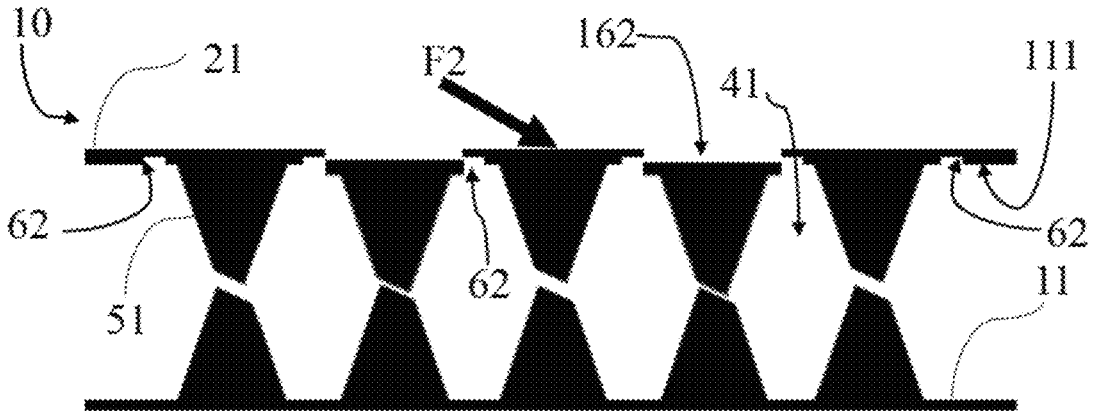
Figure 6C:
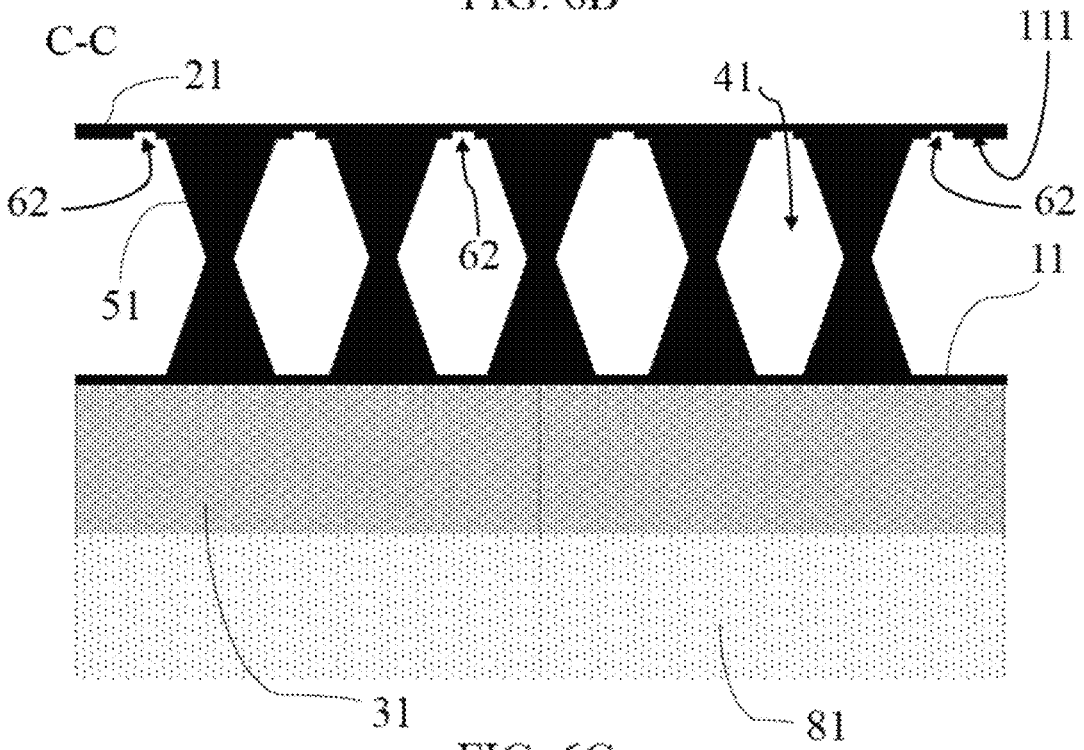

FIG. 6 illustrates by way of example the protective helmet 3 according to a sixth embodiment, which will not be described in detail below, but only with respect to the elements which differ with respect to the fifth embodiment illustrated in the FIGS. 5 and 5A-5C above, which fifth embodiment is incorporated therein by reference. Similarly, the numbering of the elements will be kept corresponding to the first embodiment when not modified.

The protective helmet 3 according to the sixth embodiment differs from the fifth embodiment of the protective helmet 2 in terms of definition of the notches 62 and respective impact portions 162 which have an identical geometry, of the hexagonal type. Particularly, in the embodiment shown in FIGS. 4 and 6, each absorption element 51 is coupled to a single impact portion 162.

According to further embodiments, not shown, it is possible to further define impact portions having a different geometry from each other and/or different from that of the hexagonal type. Furthermore, it is possible that one or more impact portions are devoid of the absorption element, i.e. coupled with the other impact portions by means of the only notches, leaving the underlying interspace volume completely devoid of other elements.

The functionality of the protective helmet 3 will not be described in detail below as it corresponds to what described previously for the protective helmet 2 of the fifth embodiment and which is incorporated for reference. Compared to the solution with impact portions 161 that copy the bone structure of the cranial theca, the hexagonal geometry allows controlled fracture areas to be obtained regardless of the morphology of the user wearing the protective helmet 3, i.e. regardless of the plurality of cranial thecae and respective sutures. Moreover, the size of the hexagons affects the number of the same and, consequently, the number of the notches and of the respective impact portions 162 subject to breaking, allowing a greater capacity of energy absorption as the number of the realized impact portions 162 increases.

The above description for the previous embodiments, including any modifications not illustrated, materials and production methods, can be applied, mutatis mutandis, to the sixth embodiment.

The protective helmet according to the present invention therefore allows to considerably reduce the energy transmitted to the cranial theca and, consequently, to the soft tissues of the user.

In fact, the energy absorption capacity makes it possible to reduce the problems connected with possible impacts and, particularly, to reduce the consequences of traumas due to oblique impacts, such as the "closed head injury". In such way, it is possible to realize a protective helmet able to considerably reduce injuries of any kind in case of angular and rotational impacts.

Furthermore, the use of a interspace allows to improve the thermal characteristics of the helmet, obtaining better insulation from the outer environment both in conditions of hot temperatures and in conditions of cold temperatures.

The invention claimed is:

1. A protective helmet comprising:

an outer shell;

one or more absorption elements of impact shock energy operatively coupled with said outer shell, wherein said one or more absorption elements are shaped with a geometric configuration which extends along a development axis such as to define a pair of end portions opposite to each other;

said protective helmet wherein said one or more absorption elements comprise a working portion interposed between said end portions, wherein a section of said working portion along a surface transverse to said development axis has an area smaller than areas of corresponding sections of said end portions, and wherein said one or more absorption elements have a breaking load lower than the breaking load of said outer shell, so that in the event of an impact said working portion is subject to breaking before said outer shell and before said end portions to allow the absorption of the impact shock energy.

2. The protective helmet according to claim 1, wherein said sections of said end portions have a different area and/or conformation.

3. The protective helmet according to claim 1, wherein said one or more absorption elements have an asymmetrical configuration with respect to said development axis.

4. The protective helmet according to claim 1, wherein said one or more absorption elements are coupled with a support element at one of said end portions so as to define a single absorption element.

5. The protective helmet according to claim 1, wherein said support element is coupled with said outer shell by means of a surface provided with a same curvature as said outer shell.

6. The protective helmet according to claim 1, wherein said one or more absorption elements are hourglass-shaped.

7. The protective helmet according to claim 1, wherein said one or more absorption elements have a cylindrical conformation provided with one or more holes at the working portion, wherein said one or more holes are transverse and/or axial to said development axis.

8. The protective helmet according to claim 1, wherein the protective helmet comprises an inner lining, wherein said one or more absorption elements are interposed between said outer shell and said inner lining.

9. The protective helmet according to claim 1, wherein the protective helmet comprises an inner lining coupled with said outer shell, wherein said one or more absorption elements are coupled with said inner lining, so that said inner lining is interposed between said outer shell and said one or more absorption elements.

10. The protective helmet according to claim 1, wherein the protective helmet comprises a coating shell, wherein said coating shell is superimposed on said outer shell.

11. The protective helmet according to claim 10, wherein said coating shell is provided with one or more notches, preferably defined along the inner surface (of said coating shell at said outer shell, able to define a predefined breaking scheme in the event of an impact.

12. The protective helmet according to claim 10, wherein said coating shell has a breaking load lower than said outer shell, and wherein said one or more absorption elements have a breaking load lower than or equal to the breaking load of said coating shell, so that in the event of an impact the working portion is subject to breaking before said coating shell or together with the breaking of at least a portion of said coating shell for the collapse of said coating shell towards said outer shell.

13. The protective helmet according to claim 10, wherein said coating shell is coupled with said outer shell or to said one or more absorption elements in a removable manner.

14. The protective helmet according to claim 1, wherein the protective helmet comprises a coating shell, wherein said one or more absorption elements are interposed between said outer shell and said coating shell.

* * * * *